US010161620B2

(12) United States Patent
Jiang et al.

(10) Patent No.: US 10,161,620 B2
(45) Date of Patent: Dec. 25, 2018

(54) LED LAMP WITH AT LEAST ONE LED MODULE WITH HEAT SINK

(71) Applicant: JIAXING SUPER LIGHTING ELECTRIC APPLIANCE CO., LTD, Zhejiang (CN)

(72) Inventors: Tao Jiang, Zhejiang (CN); Jin-Feng Xu, Zhejiang (CN)

(73) Assignee: JIAXING SUPER LIGHTING ELECTRIC APPLIANCE CO., LTD, Zhejiang (CN)

( * ) Notice: Subject to any disclaimer, the term of this patent is extended or adjusted under 35 U.S.C. 154(b) by 0 days.

(21) Appl. No.: 15/499,130

(22) Filed: Apr. 27, 2017

(65) Prior Publication Data

US 2018/0023796 A1 Jan. 25, 2018

(30) Foreign Application Priority Data

Jul. 22, 2016 (CN) ..... 2016 1 0586654
Sep. 14, 2016 (CN) ..... 2016 1 0826238
Sep. 27, 2016 (CN) ..... 2016 1 0854761

(51) Int. Cl.

| | |
|---|---|
| ***F21V 29/83*** | (2015.01) |
| ***F21K 9/68*** | (2016.01) |
| ***F21K 9/235*** | (2016.01) |
| ***F21K 9/237*** | (2016.01) |
| ***F21V 17/12*** | (2006.01) |
| ***F21K 9/232*** | (2016.01) |

(Continued)

(52) U.S. Cl.

CPC ..... *F21V 29/83* (2015.01); *F21K 9/232* (2016.08); *F21K 9/235* (2016.08); *F21K 9/237* (2016.08); *F21K 9/68* (2016.08); *F21V 17/12* (2013.01); *F21Y 2103/33* (2016.08); *F21Y 2105/18* (2016.08); *F21Y 2115/10* (2016.08)

(58) Field of Classification Search

CPC ..... F21V 29/02; F21V 29/006; F21V 29/51; F21V 29/71; F21V 29/83

See application file for complete search history.

(56) References Cited

U.S. PATENT DOCUMENTS

2007/0279909 A1* 12/2007 Li ..... F21V 19/001 362/294
2012/0085516 A1* 4/2012 McClellan ..... F21V 15/013 165/80.3

(Continued)

FOREIGN PATENT DOCUMENTS

| | | |
|---|---|---|
| CN | 103322536 | 9/2013 |
| CN | 104251476 | 12/2014 |

*Primary Examiner* — Karabi Guharay
(74) *Attorney, Agent, or Firm* — Andrew M. Calderon; Roberts Mlotkowski Safran Cole & Calderon, P.C.

(57) ABSTRACT

A LED lamp includes LED modules. Each of the LED modules includes a heat sink body having a first terminal, a second terminal opposite to the first terminal, an airway having an opening at the second terminal, and a side hole on the side surface of the body. The side hole communicates with the corresponding airway. The LED modules are aligned to form concentric circles including an inner circle and an outer circle. The length between the first and the second terminals of each LED module at the inner circle is longer than that at the outer circle. Accordingly, heat generated by LEDs on the first terminals can be dissipated through the airways and the heat sink bodies.

20 Claims, 15 Drawing Sheets

(51) Int. Cl.

| | |
|---|---|
| *F21Y 105/18* | (2016.01) |
| *F21Y 115/10* | (2016.01) |
| *F21Y 103/33* | (2016.01) |

(56) References Cited

U.S. PATENT DOCUMENTS

2016/0025322 A1* 1/2016 Chen ..... F21V 29/773
362/373
2016/0153647 A1* 6/2016 Lin ..... F21V 29/71
362/382

* cited by examiner

300

300

LED LAMP WITH AT LEAST ONE LED MODULE WITH HEAT SINK

CROSS-REFERENCE TO RELATED APPLICATIONS

This application claims the priorities of Chinese application No. 201610586654.6 filed on Jul. 22, 2016, Chinese application No. 201610826238.9 filed on Sep. 14, 2016, and Chinese application No. 201610854761.2 filed on Sep. 27, 2016, and the entirety of which is incorporated by reference herein.

BACKGROUND

Technique Field

The present invention relates to an LED lamp and in particular relates to an LED lamp comprising at least one LED module with a characteristic of high heat-dissipation.

Description of the Related Art

LED lamps are widely used to replace conventional incandescent lamps in the market because of their advantages of long life-time, small size and power saving. Heat-dissipation is a very important consideration during design. China laid-open publication No. 104251476A discloses an LED module with a vertical convection heat-dissipation structure, comprising an optical assembly, a substrate, an LED light source and a heat sink, wherein the optical assembly is fixedly connected to the heat sink. The LED module further comprises a heat-dissipation column disposed on one side of the heat sink, wherein a vent is formed in the central of the heat sink to form a vertical heat-dissipation structure. Accordingly, a better heat-dissipation property can be provided to a lamp with narrow space. However, the LEDs are usually distributed on the edge of the bottom surface of the heat sink which will result in an LED module with a larger size, and the vertical convection heat-dissipation will be highly reduced when more LED modules are incorporated. It's a tradeoff between the numbers of LED modules and the heat-dissipation. Besides, the conventional LED modules are suffering from the problems of low recycling rate, different heat sinks for different LED modules with various powers, and high costs for development of various LED modules.

In order to resolve above-mentioned disadvantages, China laid-open publication No. 103322536A discloses an LED aluminum pipe drilling efficient heat-dissipation device, comprising a heat-dissipation aluminum plate, a plurality of mounting holes, a plurality of aluminum pipes installed in the mounting holes and located on the same side of the heat-dissipation aluminum plate, and a plurality of heat-dissipation holes are arranged on the aluminum pipes. Accordingly, the heat generated by the LEDs can be efficiently dissipated into air through the aluminum pipes and the heat-dissipation holes, and the LED aluminum pipe drilling efficient heat-dissipation device can be conveniently installed. However, the numbers of the aluminum pipes corresponding to the LEDs will increase with the numbers of LEDs, when many LEDs/pips are installed, the heat convection effect may be lowered even a plurality of drilling holes are formed on the crowded aluminum pipes.

SUMMARY

To address the above-mentioned issues, an LED lamp comprising at least one LED module with high heat-dissipation effect is provided.

According to an embodiment of the LED lamp, the LED lamp comprises a plurality of LED modules. Each of the LED modules comprises a heat sink body having a first terminal, a second terminal opposite to the first terminal, an airway having an opening at the second terminal, and at least one side hole on the side surface of the body, the at least one side hole communicates with the airway. The plurality of LED modules are aligned to form concentric circles including an inner circle and an outer circle. The length between the first and the second terminals of each of the plurality of LED modules at the inner circle is longer than the length between the first and the second terminals of each of the plurality of LED modules at the outer circle.

According to an embodiment of the LED lamp, the LED lamp further comprises a plate. The plate comprises a plurality of mounting holes thereon. Each of the plurality of LED modules comprises a connecting part corresponding to one of the heat sink body. Each of the connecting part is on the first terminal of the corresponding heat sink body. The plurality of LED modules is connected with the plurality of mounting holes, respectively.

According to an embodiment of the LED lamp, the area between the inner tangent line of the mounting holes on the inner circle and the outer tangent line of the mounting holes on the outer circle is one to four times of the total areas of the plurality of mounting holes.

According to an embodiment of the LED lamp, each of the plurality of heat sink body comprises a stepped surface at the second terminal of the heat sink body. The stepped surface comprises an upper inclined surface, a lower inclined surface, and a shoulder surface connected between the upper and the lower inclined surfaces. A distance from the plate to the lower inclined surface of each of the plurality of LED module at the inner circle is longer than a distance from the plate to the upper inclined surface of each of the plurality of LED modules at the outer circle.

According to an embodiment of the LED lamp, the ratio of the height h1 of the connecting part over the height H of the LED module is about 0.04 to 0.25, and the ratio of the height h2 of the shoulder surface to the height H of the LED module is about ⅙ to ½.

According to an embodiment of the LED lamp, a position of each of the openings of the plurality of the LED modules at the inner circle is higher than, from the plate, a position of each of the openings of the plurality of the LED modules at the outer circle.

According to an embodiment of the LED lamp, a position of each of the openings of the plurality of the LED modules at the inner circle is higher than, from the plate, a position of the corresponding second terminal of the plurality of the LED modules at the outer circle.

According to an embodiment of the LED lamp, the LED lamp comprises a plurality of LED units. Each of the plurality of LED units comprises three of the plurality of LED modules adjacent to each other. One LED module of each of the plurality of LED units is arranged on the inner circle and the other two LED modules of each of the plurality of LED units are arranged on the outer circle.

According to an embodiment of the LED lamp, each of the three LED modules of each of the LED units has a trench on the surface adjacent to the other two LED modules. The longitudinal axes of the trenches are substantially parallel to the longitudinal axes of the heat sink bodies of the LED units. The three adjacent trenches forms a channel with a first aperture and a second aperture opposite to the first aperture.

According to an embodiment, a heat sink for an LED module comprises a heat sink body. The heat sink body has a first terminal, a second terminal opposite to the first terminal, an airway having an opening at the second terminal, and a side hole on the side surface of the body. The side hole communicates with the airway. A surface of the second terminal is a stepped surface or an oblique surface.

According to an embodiment, the heat sink body comprises a stepped surface. The stepped surface comprises an upper inclined surface, a lower inclined surface, and a shoulder surface connected between the upper and the lower inclined surfaces. The longitudinal axis of the shoulder surface is substantially parallel to the longitudinal axis of the airway.

According to an embodiment, the shoulder is substantially on the same surface as the longitudinal axis of the airway on.

According to an embodiment, the upper inclined surface and the lower inclined surface are not substantially parallel to each other.

According to an embodiment, the heat sink body comprises an oblique surface. the normal line to the oblique surface and the longitudinal axis of the airway creates an acute angle.

According to above description, the longer length of the LED modules at the inner circle than that at the outer circle increases efficiency of heat-dissipation from the LEDs. The side holes and the airways could individually or jointly improve thermal convection of the LED modules. The arrangement of the LED modules and the plate further makes the second terminals at the inner circle exposed and not being blocked by the second terminals at the outer circle. Hence, efficiency of heat-dissipation is further improved. The stepped surfaces at the second terminal increase the area of the opening of the airways at the second terminals. Accordingly, thermal convection is further improved. The feature of the position of the openings of the airways at the inner circle are higher than that at the outer circle improves thermal convection furthermore. The trenches of the plurality of LED units could improve the thermal convection as well.

DETAILED DESCRIPTION

The making and using of the embodiments of the present disclosure are discussed in detail below. However, it should be noted that the embodiments provide many applicable inventive concepts that can be embodied in a variety of specific methods. The specific exemplary embodiments discussed are merely illustrative of specific methods to make and use the embodiments, and do not limit the scope of the disclosure. Furthermore, the terms "longitudinal axis", "top", "bottom" are used to distinctly explain the relative positions of the elements depicted in the embodiments instead to limit the scope of this invention. Moreover, the terms "substantially perpendicular" and "horizontal" are defined as ±30% of the standard definition thereof. For example, the standard definition of "substantially perpendicular" is 90 degrees to a base line, but it is defined as the angle ranging between 60 to 120 degrees in this present invention.

Exemplary Embodiment 1

Figure 1:
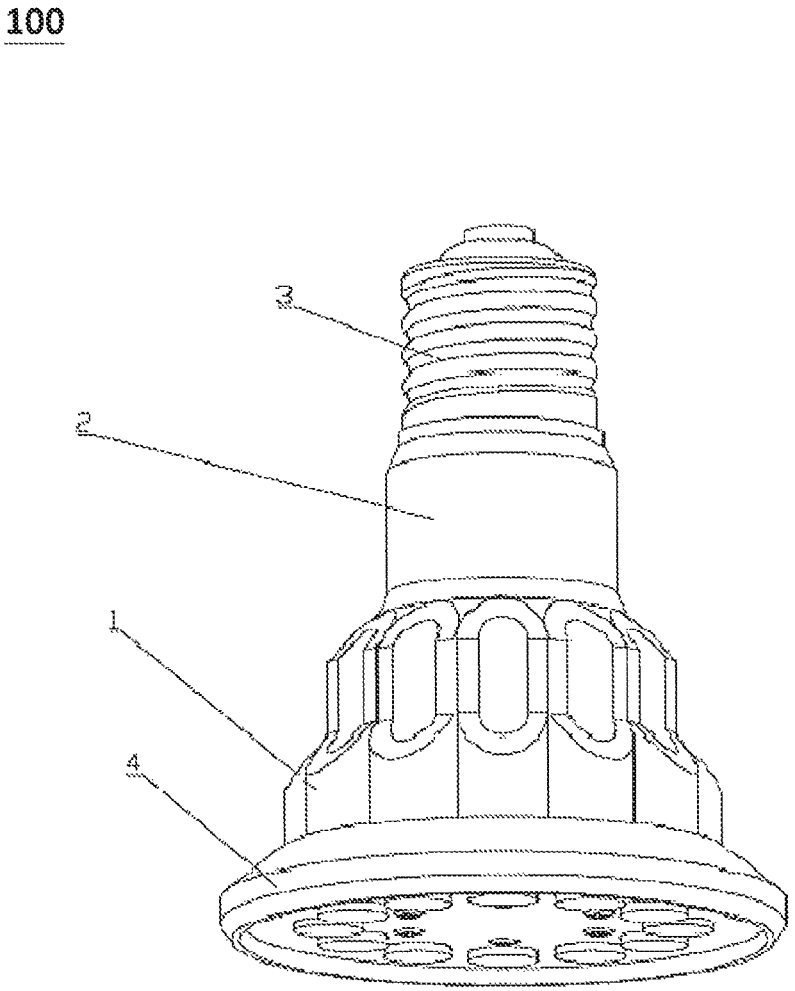
FIG. 1 illustrates a perspective view the embodiment 1 of the LED lamp.

The embodiment 1 will be described below with reference to the accompanied FIGS. 1 to 4. First, please refer to FIG. 1, which is a perspective view of the embodiment 1 of an LED lamp 100. As illustrated in FIG. 1, the LED lamp 100 comprises a plate 4, a plurality of LED modules 1 mounted on the plate 4, a plastic casing 2 and a lamp base 3. The lamp base 3 is used to interconnect with a power supplying source (not shown) and provides electrical power to drive the LEDs (not shown) of the LED modules 1.

Figure 2:
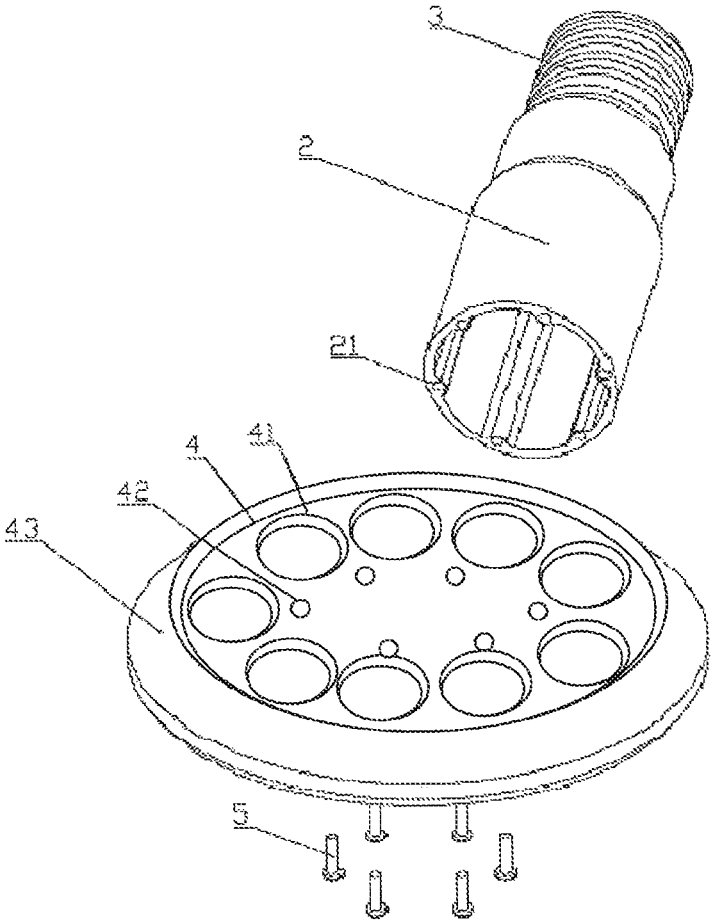
FIG. 2 illustrates a de-assembled view of the LED lamp as illustrated in FIG. 1 after removing the LED modules.

As illustrated in FIG. 2, the shape of the plate 4 is substantially circular, and plates with other suitable shapes can also be selected as the plate 4 in other embodiments. A plurality of mounting holes 41 are formed on the plate 4, and each of the LED modules 1 is inserted into each of the mounting holes 41 and fastened therein to expose the LEDs (light emitting diodes) formed on the LED modules 1. The mounting holes 41 of this embodiment are circular countersunk-head holes, and each LED module 1 is supported by the structure of each circular countersunk-head hole. Countersunk-head holes with other shapes can also be chosen based on the shape of the cross-section of the heat sink 10. As illustrated in FIGS. 1 and 2, each of LED modules 1 is independently mounted onto the plate 4 by being inserted into the corresponding mounting hole 41. The LED modules 1 can also be assembled together first to form an assembly of the LED modules, and the assembly of the LED modules is mounted onto the plate 4 thereafter. As illustrated in FIG. 2, a plurality of screw holes 42 are formed on the plate 4 and located between the center of the plate 4 and the mounting holes 41. The bottom (not labeled) of the plastic casing 2 is fixed on the plate 4 by screwing with screws 5 from the screw hole 42 on the plate 4 to the screw holes 21 on the edge of the bottom of the plastic casing 2. The lamp base 3 formed on the top of the plastic casing 2 is used to connect with a corresponding lamp socket (not shown).

The LEDs 30 of the LED modules 1 are interconnected with each other for example in series. In the embodiment where the LEDs are connected in series, the in-series-connected LEDs are connected with a power supplying source shown). Specifically, the LED at one end of the in-series-connected LEDs is connected with cathode of the power supplying source and the LED at the other end of the in-series-connected LEDs is connected with anode of the power supplying source. A wire hole (not shown) may be formed at the center of plate 4 (the center of the circle tangent to the screw holes 42) so that after the LEDs installed on mounting holes 41 by a conductive wire (not shown), the conductive wire may pass through the wire hole to electrically connected to the lamp base 3 and power supplying source.

Figure 3A:
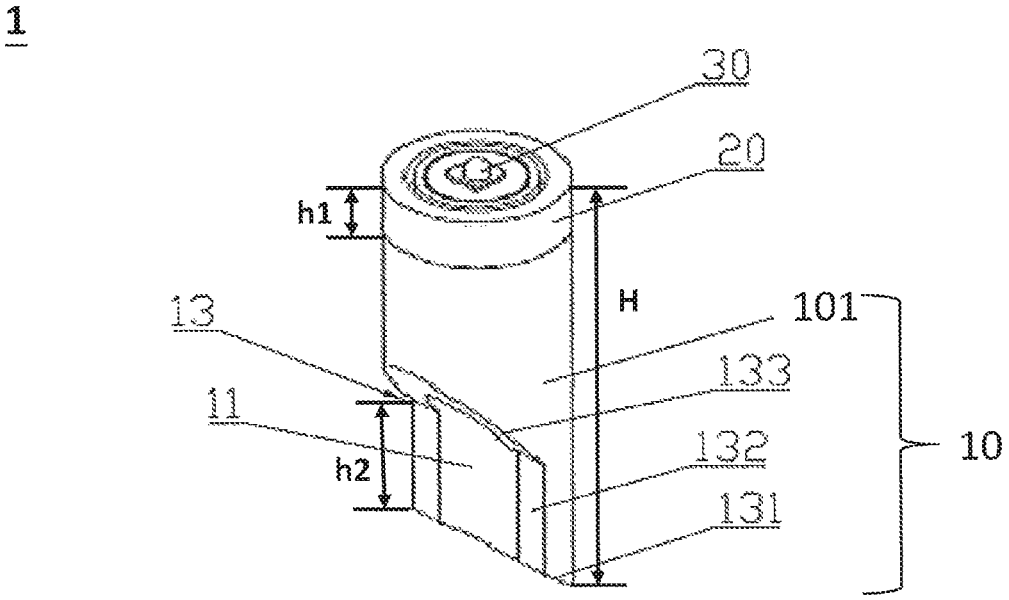
FIGS. 3A~3E illustrate perspective views of embodiments of the LED modules for the LED lamp as illustrated in FIG. 1.

Next, please refer to FIG. 3A, which illustrates an LED module 1 as shown in FIG. 1. As illustrated in FIG. 3A, each of the LED modules, comprises a heat sink 10, a connecting part 20 capped on the heat sink 10, and an LED 30 on the connecting part 20. The LED 30 may comprise an LED chip (not shown) packaged with a lead frame (not shown). The heat sink 10 comprises a heat sink body 101 having a first terminal (not labeled) and a second terminal (not labeled) opposite to the first terminal (not labeled), an airway 11 communicating the first terminal (not labeled) and the second terminal (not labeled), and a stepped surface 13 at the second terminal (not shown) of the body 101. (In another embodiment, the airway 11 has opening at the second terminal, but does not communicate with outer air through the first terminal. In other words, the end of the airway 11 at the first terminal is blocked. The body 101 of this embodiment is a hollow tube with a circular cross-sectional area, and the inlet and the outlet of the airway 11 are of the same diameter to ensure that the heat generated by the LED 30 can be dissipated evenly. A hollow tube with a cross-sectional area of other shape such as rectangular can also be selected as the body 101 in other embodiments. The body 101 can be made of materials with good thermal conductivities, such as aluminum alloy 1070 , 1050, 6061 and 6063, and preferably aluminum alloy 6063. The body 101 can also be made of other materials with good thermal conductivities in other embodiments. The connecting part 20 can be made of aluminum alloy, and preferably aluminum alloy 6063. The connecting parts 20 corresponds to heat sink body 101 and are, respectively, on the first terminal of the corresponding heat sink body. In one embodiment, the connecting part 20 is joined with the heat sink 10 by a glue (not shown) with a high thermal conductivity, and the LED 30 is on the connecting part 20 by the glue (not shown) with a high thermal conductivity. By means of the glue with a high thermal conductivity, the heat sink 10, the connecting part 20 and the LED 30 can be easily joined together with less cost. As illustrated in FIG. 3A, the ratio of the height h1 of the connecting part 20 over the height H of the LED module 1 is about 0.04 to 0.25 to ensure that an attractive appearance can be fabricated with minimal cost.

As illustrated in FIG. 3A, heat sink body 101 comprises a stepped surface 13 at the second terminal (not labeled) of the body 101, where is away from the connecting part 20. The airway 11 is partially exposed along its axis by means of the stepped surface 13. The stepped surface 13 comprises an upper inclined surface 131, a lower inclined surface 133, and a shoulder surface 132 connected between the upper inclined surface 131 and the lower inclined surface 133. In the embodiment, the shoulder surface 132 extends along the longitudinal axis of the airway 11, and preferably the shoulder surface 132 is substantially on the same surface as the longitudinal axis of the airway 11 on. In one embodiment, the shoulder surface 132 may be substantially parallel to the longitudinal axis of the airway 11. The ratio of the height h2 of the shoulder surface 132 over the height H of the LED module 1 is about ⅙ to ½. The angle created by the upper inclined surface 131 and the horizontal surface (not labeled, the surface perpendicular to the axis of the heat sink body 101) is about 45 to 50 degrees. The angle created by the lower inclined surface 133 and the horizontal surface (not labeled) is about 43 to 48 degrees. The angle created by the shoulder surface 132 and the horizontal surface (not labeled) is about 43 to 90 degrees. The upper inclined surface 131 and the lower inclined surface 133 are oblique to the longitudinal axis of the airway 11, and preferably the upper inclined surface 131 and the lower inclined surface 133 are oblique to the longitudinal axis of the airway 11 with the same inclined angle. Either the upper inclined surface 131 or the lower inclined surface 133 can also be substantially perpendicular to the longitudinal axis of the airway 11 in other embodiments.

Figure 3B:
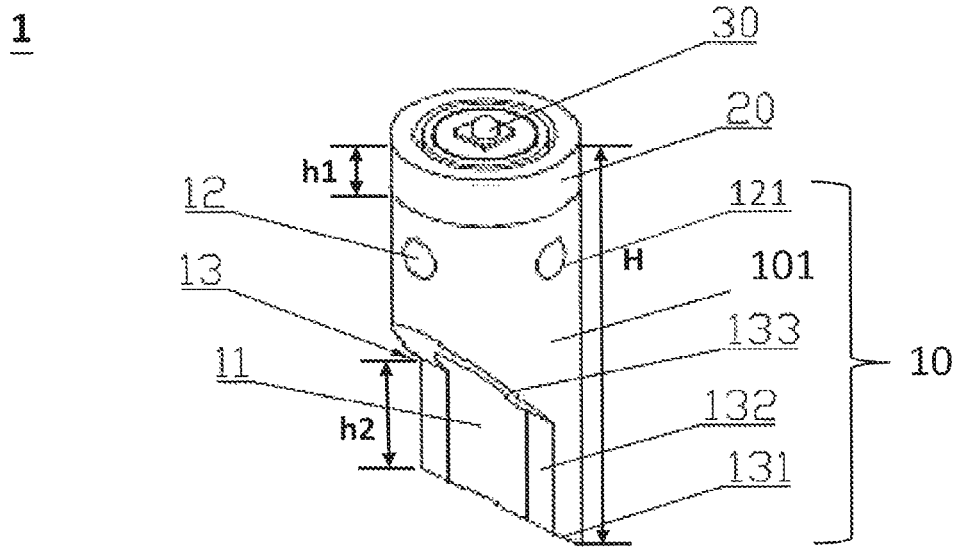

In other embodiments, FIG. 3B illustrates another LED module 1 for the embodiment 1 of the LED lamp. The LED module 1 illustrated in FIG. 3B further comprises at least one side hole 12 which is formed on the side surface of the body 101 adjacent to the connecting part 20 and communicates with the corresponding airway 11. The side holes 12 and its corresponding airway 11 means the side holes 12 and the airway 11 on the same heat sink body 101. As illustrated in FIG. 3B, there are four side holes 12 evenly surrounding the side surface of the body 101. The number of the side holes 12 of other embodiments can be 1, 2, 3 or more. The experiments indicate that a better chimney effect for heat dissipation can be achieved by forming some but not too many side holes 12 on the circumferential surface at the same axis position of the body 101. The chimney effect of heat dissipation will be reduced once the side holes 12 are formed at different axis positions of the body 101. As illustrated in FIG. 3B, the openings 121 of the side holes 12 are exposed on the side surface of the body 101, whereby a part of the hot air heated by LEDs 30 enters into the airway 11 through the side holes 12 and then the part of hot air flows out of the heat sink body. The rest of the hot air heated by LEDs 30 can be directly dissipated through the airway 11. The heat-dissipation can be enhanced by designing a desired angle between axes of each side holes 12 and the airway 11. Preferably the axis of each of the side holes 12 is substantially perpendicular to the axis of the airway 11. Accordingly, the heat generated by the LED 30 can be dissipated directly into the airway 11 and indirectly into the airway 11 through the side holes 12. The ratio of the radius of each side holes 12 over the radius of the 11 airway is about ⅛ to ⅗. Preferably, the body 101 has a thickness of about 1.5 mm to 4 mm, and the ratio of the outer radius of the airway 11 over the outer radius of the body 111 is about 0.5 to 0.8, and the distance from the center of the side holes 12 to the connecting part 20 is about 6 mm.

When the LED module 1 is operated, the heat generated by the LED 30 is conducted to the connecting part 20 and the heat sink 10, and the air within the airway 11 is heated and expanded, then the hot air goes up to be exhaled out of the heat sink 10, and the cold air subsequently enters into the airway 11 via the side holes 12. Accordingly, a small-sized heat-dissipation device with a good thermal convection can be achieved by the chimney effect mentioned above. As illustrated in FIG. 3B, the heat generated by each LED 30 on each heat sink 10 can be individually dissipated through the corresponding airway 11 of each heat sink body. Accordingly, the heat generated by a plurality of LEDs can be more efficiently dissipated respectively through corresponding airways than through a same airway. Moreover, the size of the heat sink can be greatly minimized and the heat-dissipation efficiency can be highly enhanced. In comparison with a device with the LEDs around the center of the plate 4 or a device with the LEDs surrounding the area corresponding to the center of the plastic casing 2, the above-mentioned embodiment with the LED modules mounted around the outer edge of the plate 4 could emit similar optical power but have the advantages of better heat-dissipation efficiency, lower production cost, and smaller overall size.

Figure 3C:
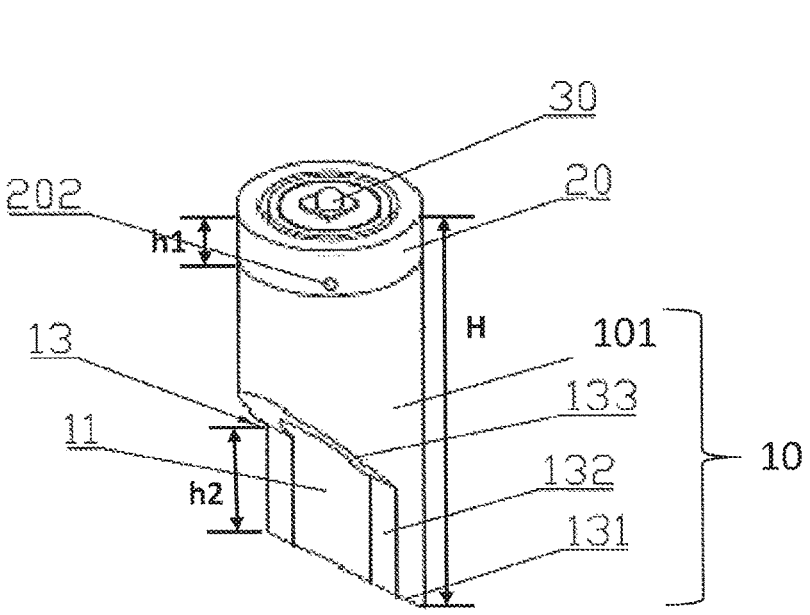
Figure 3D:
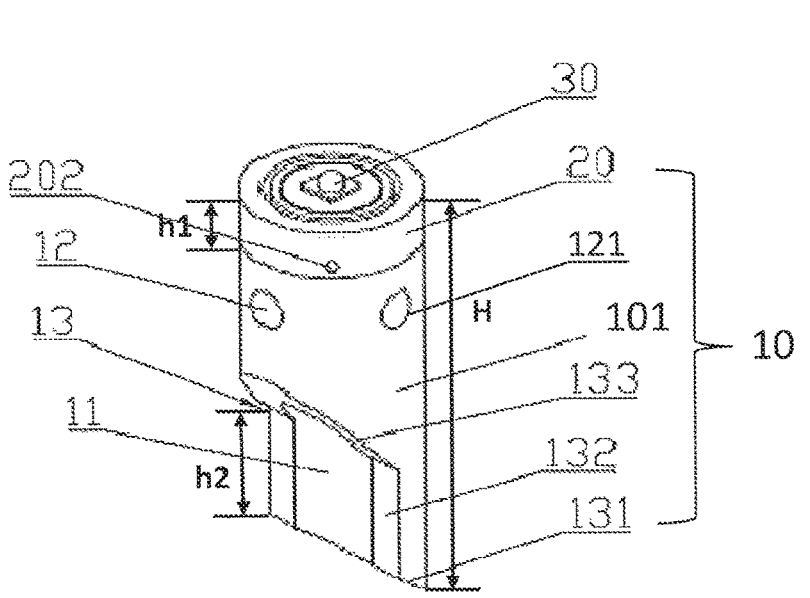

In other embodiments, as illustrated in FIGS. 3C and 3D, at least one channel 202 is further formed on the side surface of the connecting part 20 of the LED modules 1. Each channel 202 comprises an axial section (not shown) and a radial section (not shown) communicating with the axial section. The axial section is communicates with the airway 11. Accordingly, the channel 202 provides another pathway for thermal convection.

Figure 3E:
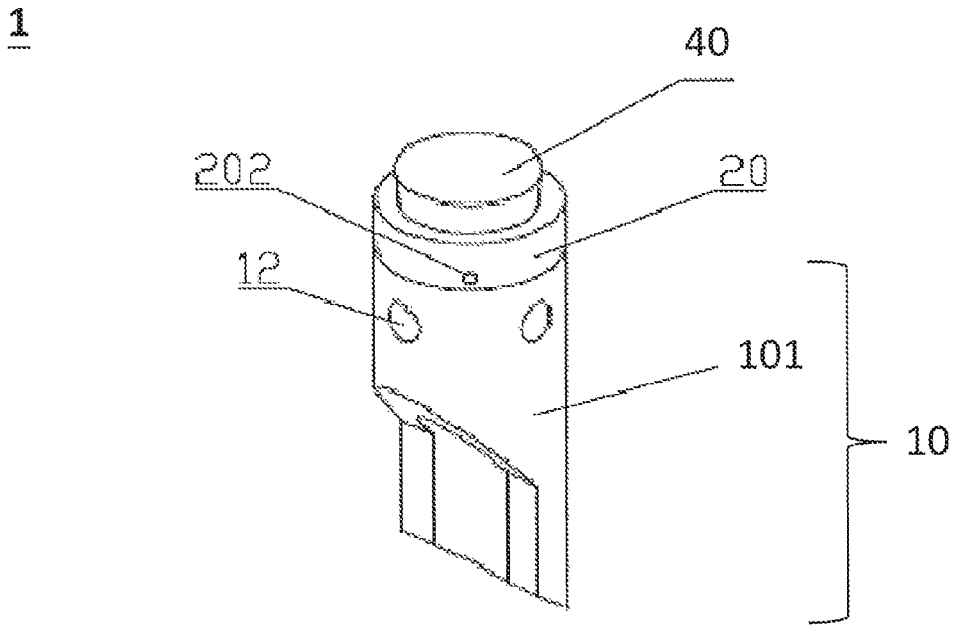

In other embodiments, as illustrated in FIG. 3E, the LED 30 on the connecting part 20 of the LED module 1 as shown in FIG. 3D is further capped with a reflector 40 to prolong its lifetime. Similarly, the LED 30 on the connecting part 20 of the LED modules 1 as shown in FIGS. 3A~3C can also be capped with the reflector 40. Furthermore, the chip (not shown) of the LED 30 of other embodiments can be further be encapsulated by a lens (not shown) to adjust the emitting angle of the LED lamp 100.

Exemplary Embodiment 2

Figure 4:
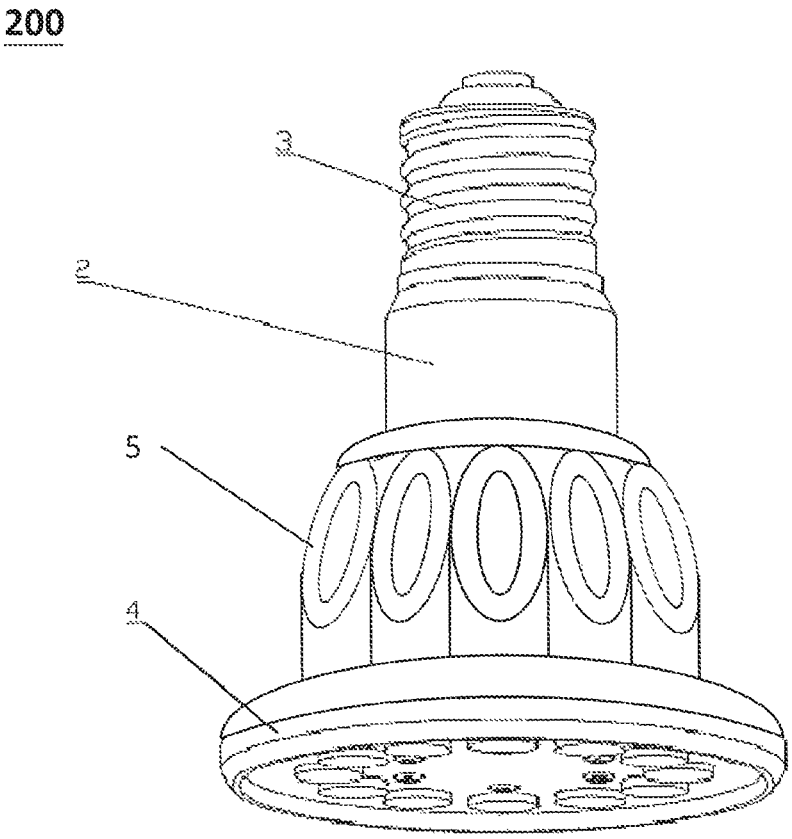
FIG. 4 illustrates a perspective view of the embodiment 2 of the LED lamp.
Figure 5A:
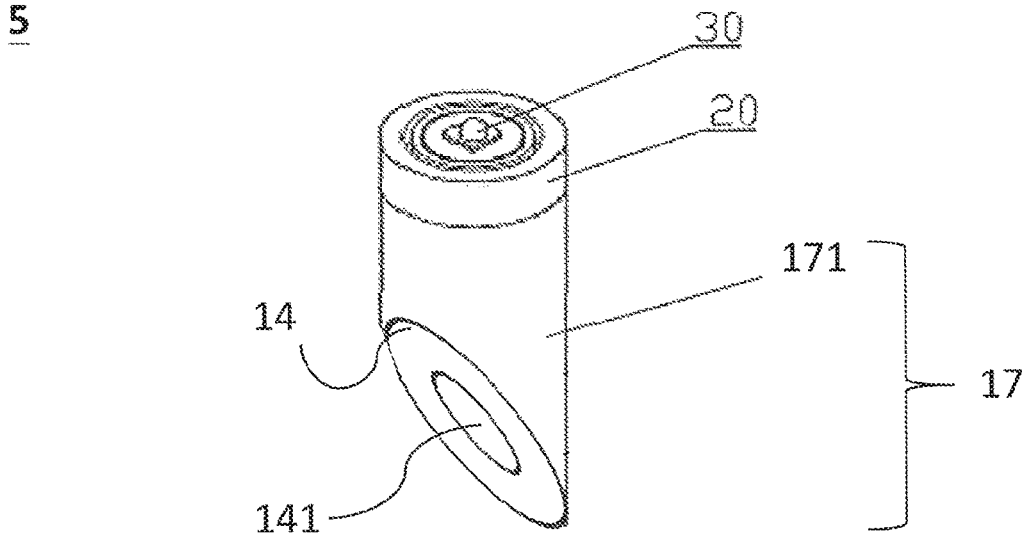
FIGS. 5A~5E illustrate perspective views of embodiments of the LED modules for the LED lamp as illustrated in FIG. 4.
Figure 5B:
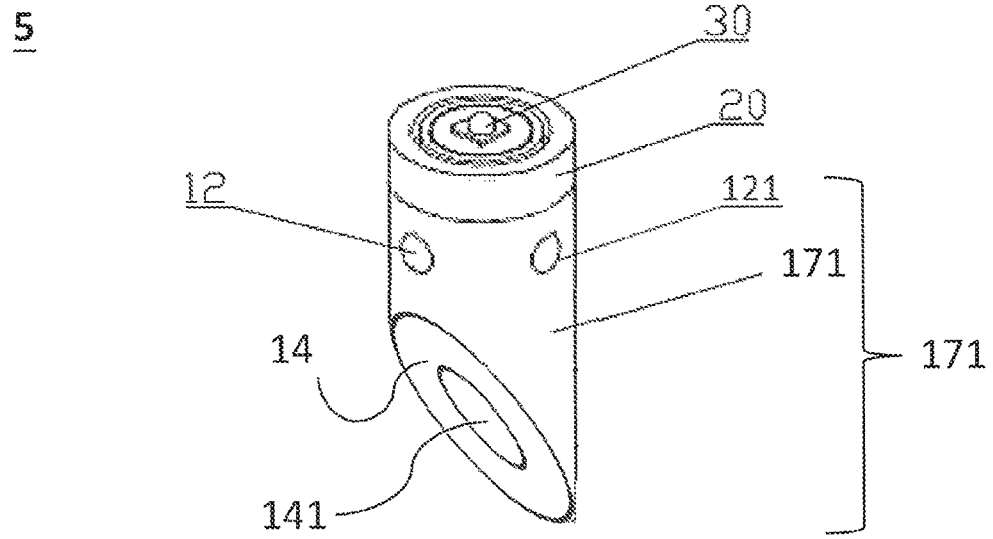
Figure 5C:
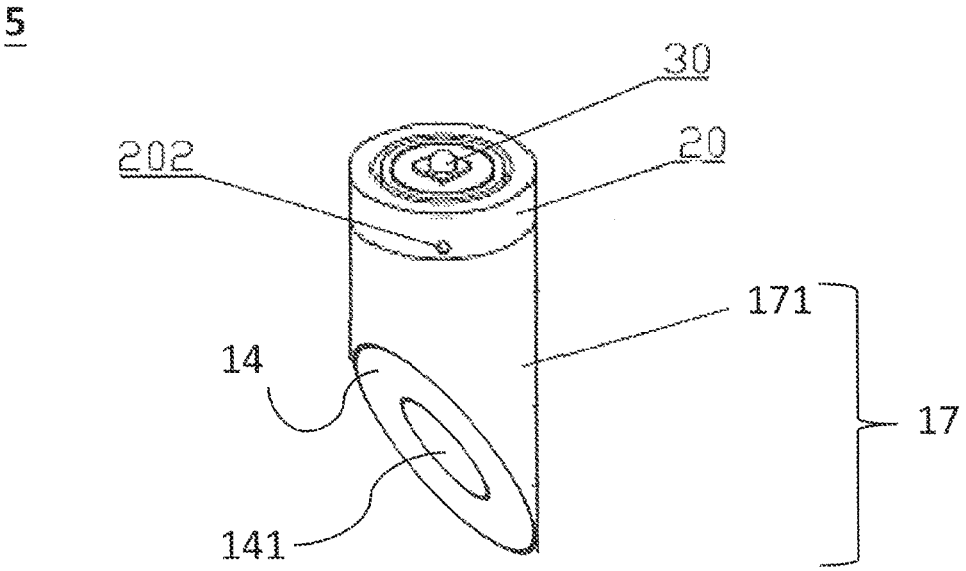
Figure 5D:
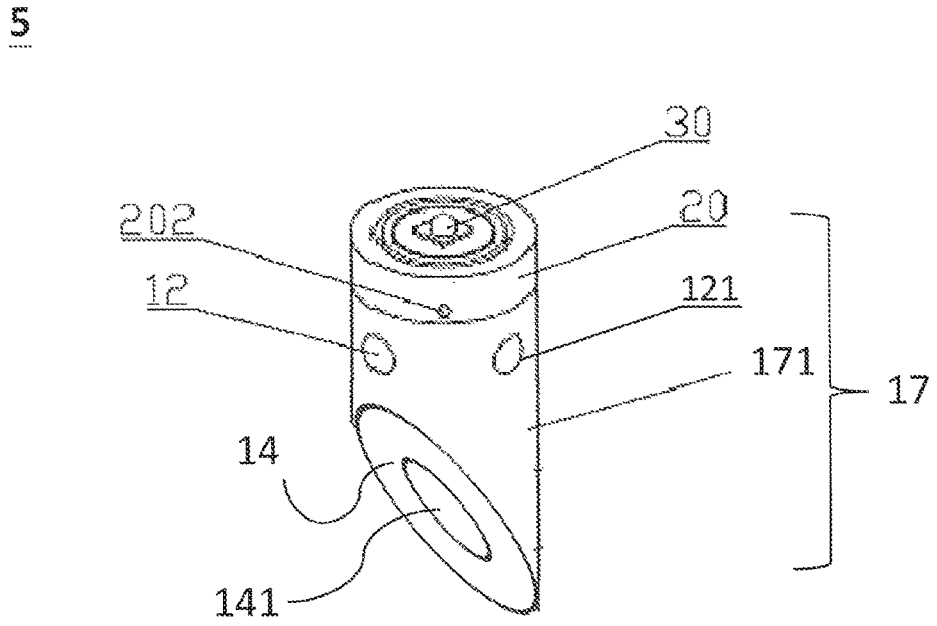
Figure 5E:
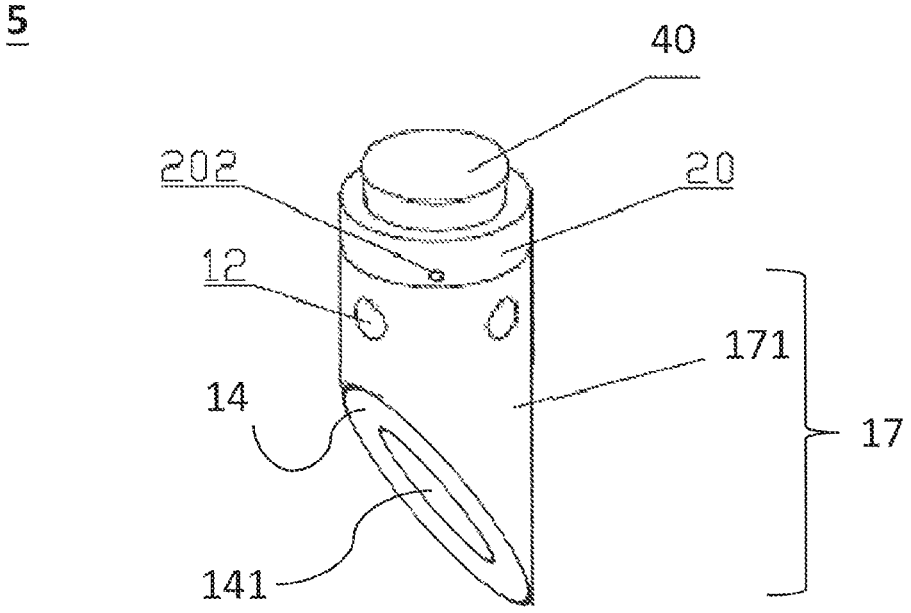

The LED lamp 200 illustrated in FIG. 4 is similar to the LED lamp 100. The LED modules 5 of the LED lamps 200 is different from that of LED lamp 100.

As illustrated in FIGS. 5A~5E, the structure of the LED module 5 is similar to that of the LED modules 1 as illustrated in FIGS. 3A~3E. The heat sink body 171 of the heat sink 17 of the LED module 5 has an oblique surface 14 at the second terminal instead of a stepped surface 13. The normal line to the oblique surface 14 and the longitudinal axis of the airway 141 creates an acute angle. Preferably the angle is less than 60 degrees. The thermal convection can be enhanced by the oblique surface 14 and the heat generated by the LED 30 can be dissipated more efficiently. As for the side holes 12 and channel 202 illustrated in FIGS. 3B~3E can also be formed on the LED module 5 illustrated in FIGS. 5B~5E to enhance the heat-dissipation of each LED 30. Details of the side holes 12 and channels 202 will not be repeatedly discussed.

Exemplary Embodiment 3

Figure 6:
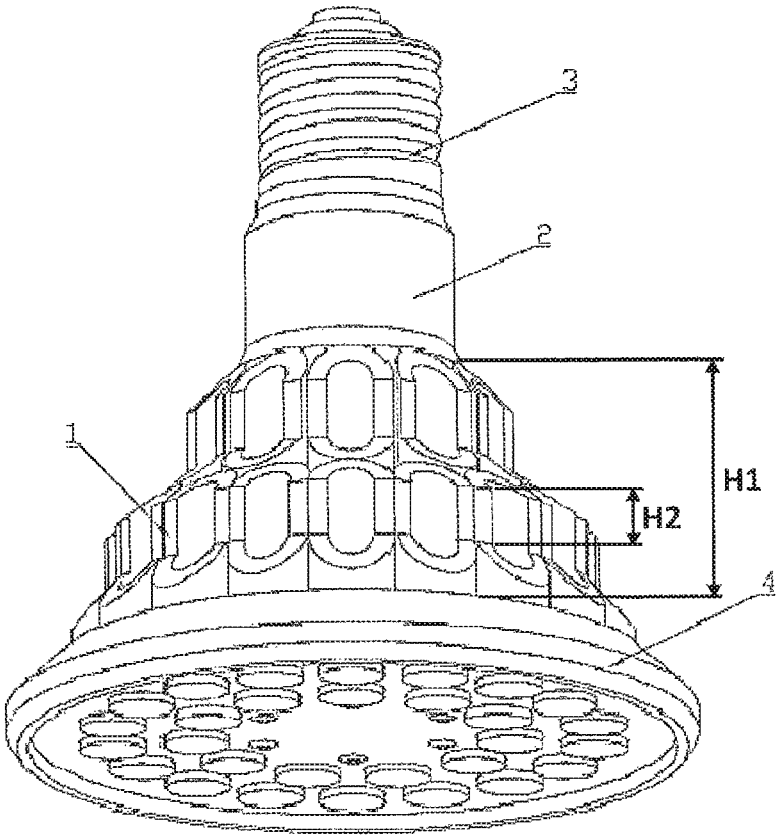
FIG. 6 illustrates a perspective view of the embodiment 3 of the LED lamp.

The embodiment 3 will be described below with reference to the accompanied FIGS. 6 to 11. The LED lamp 300 of this embodiment is similar to the LED lamp 100 disclosed in the embodiment 1 and the LED lamp 200 disclosed in the embodiment 2. As illustrated in FIG. 6, the LED lamp 300 comprises a plate 4, a plurality of LED modules 1 or 5 mounted on the plate 4, a plastic casing 2 and a lamp base 3. The lamp base 3 is used to interconnect with a power supplying source (not shown) and provides electrical power to drive the LEDs (not shown) of the LED modules 1 or 5. The LED modules 1 or 5 illustrated in FIGS. 3A~3E and FIGS. 5A~5E can all be utilized in the LED lamp 300 of this embodiment. The LED module 1 illustrated in FIG. 3E is taken as an example in this embodiment for exemplary description.

Figure 9:
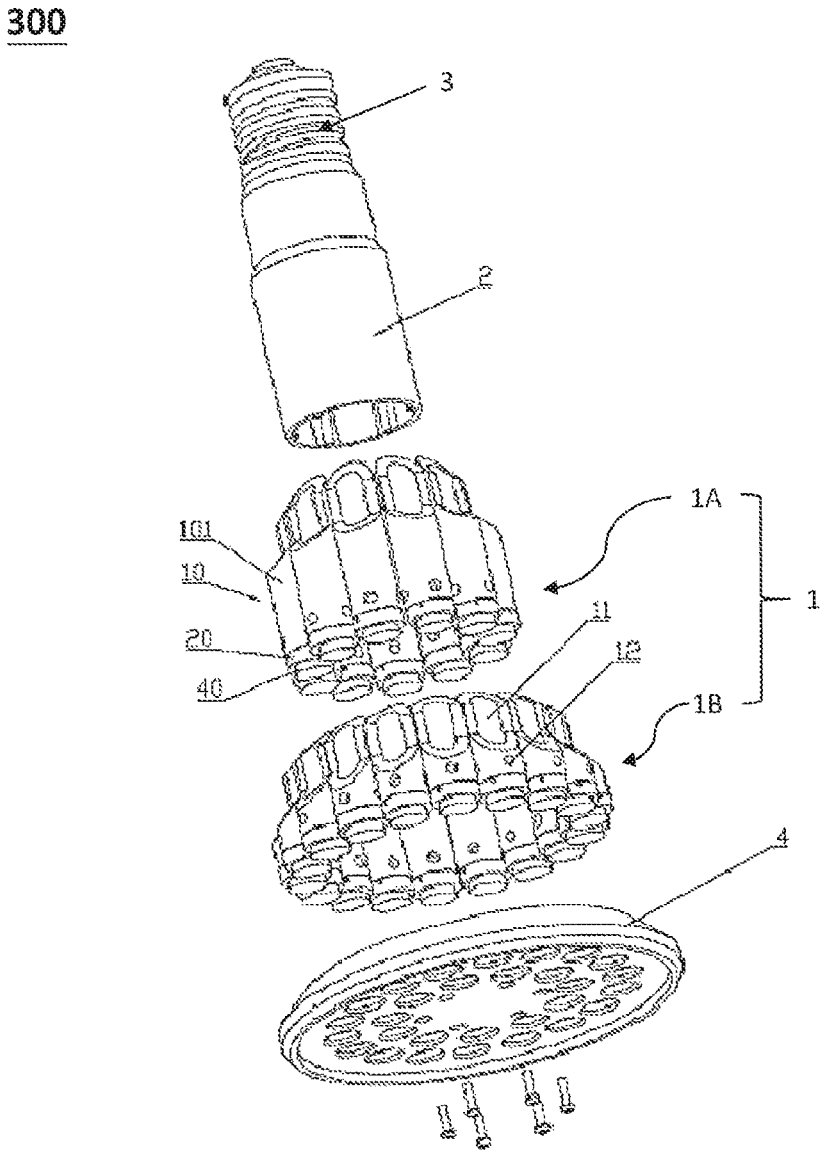
FIG. 9 illustrates an exploded view of the LED lamp as illustrated in FIG. 6.
Figure 10:
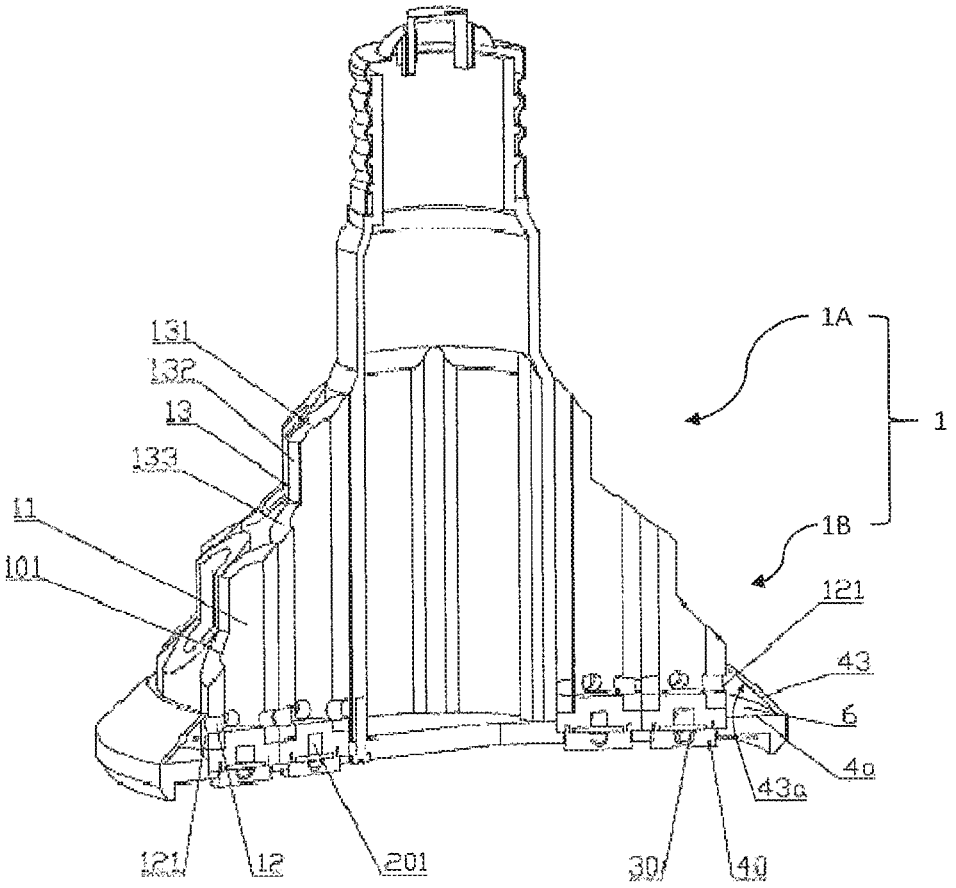
FIG. 10 illustrates a cross-sectional view of the LED lamp as illustrated in FIG. 6.

As illustrated in FIGS. 6 and 9, the plurality of LED modules 1A and 1B are aligned to form concentric circles including an inner circle and an outer circle. Each of the LED modules comprises a heat sink body having a first terminal and a second terminal. The length between the first terminal and the second terminal of each LED modules 1A at the inner circle is longer than that at the outer circle. Hereinafter, the LED modules at the inner circle is referred as inner LED modules 1A and the LED modules at the outer circle is referred as outer LED modules 1B. The height H1 (from the plate 4 to the top of the second terminal) of the inner LED module 1A is greater than the height H2 of the outer module 1B. As illustrated in FIG. 6, the height of the lamp base relative to the plate 4, height H1 (the height of the inner LED module 1A relative to the plate 4), and height H2, the height of the outer LED module 1B relative to the plate 4, decrease in order to form a tower-shaped LED lamp 300. As illustrated in FIG. 10, the lower inclined surface 133 of the heat sink 10 in the inner LED module 1A is preferably higher than the upper inclined surface 131 of the heat sink 10 in the outer LED module 1B. This tower-shaped LED lamp 300 possesses not only a characteristic of high heat-dissipation but also an attractive appearance with an advantage of power saving. The height of each heat sink 10 in the inner LED module 1A is about 60 to 100 mm, and the height of each heat sink 10 in the outer LED module 1B is about 40 to 70 mm. The inner diameter of the heat sink 10 is about 8 to 16 mm, and the outer diameter of the heat sink 10 is about 14 to 20 mm. In other embodiments, the design with an outer LED module 1B taller than an inner LED module 1A can also be adopted. In this embodiment, the second terminal of the inner LED modules 1A are totally exposed and not blocked by the second terminals of the outer LED modules 1B. However, in another embodiment, the second terminals of the outer LED modules 1B may block a portion of the second terminals of the inner LED modules 1A. In another embodiment, the position of each of the openings of the inner LED modules 1A is higher than, from the plate 4, the position of the openings of the outer LED modules 1B. Specifically, the openings of the inner LED modules 1A may be totally or partially higher than that of outer LED modules 1B. In another embodiment, the position of the openings of the inner LED modules 1A is higher than, from the plate, the position of the corresponding second terminals of the outer LED modules 1B. In other words, the second terminals of the outer LED modules 1B my block a portion of the openings of the airways at the second terminals of the inner LED modules 1A.

Figure 7:
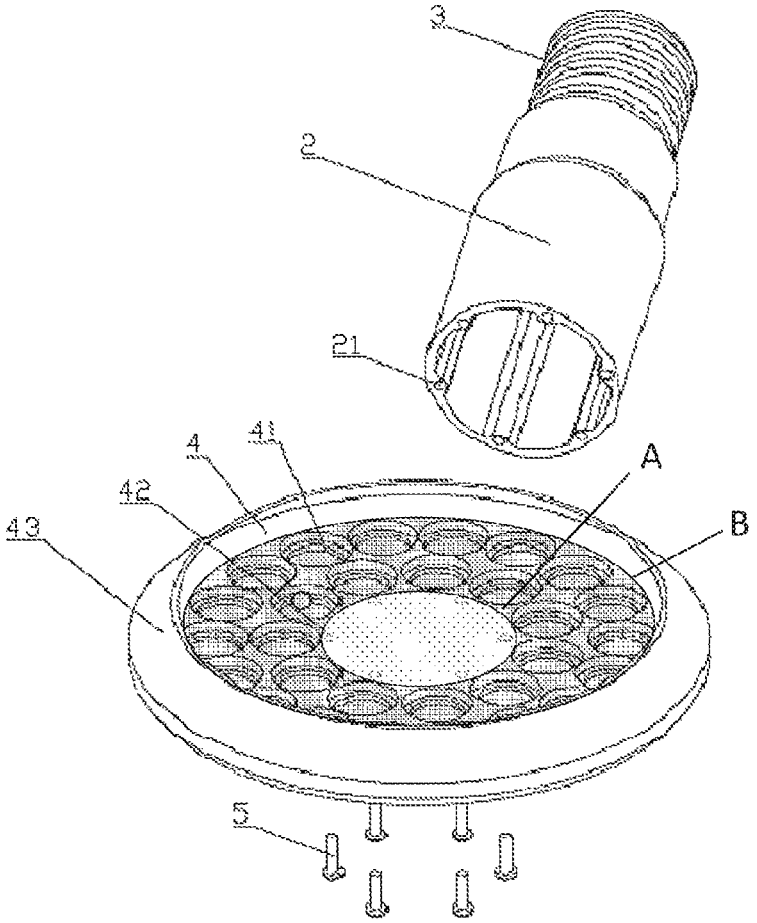
FIG. 7 illustrates a de-assembled view of the LED lamp as illustrated in FIG. 6 after removing the LED modules.
Figure 8:
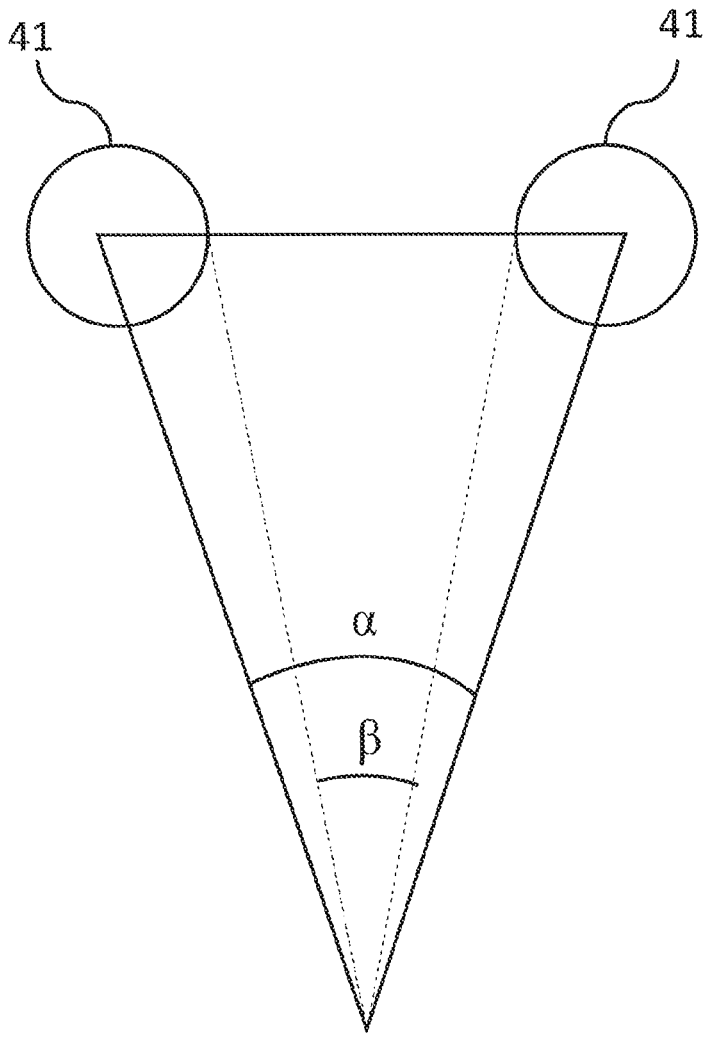
FIG. 8 illustrates the angle $\alpha$ between the centers of two adjacent mounting holes of the same circle on the plate, and the angle $\beta$ between the edges of two adjacent mounting holes of the same circle on the plate.

As illustrated in FIG. 7, a plurality of mounting holes 41 are formed on the plate 4 and arranged to surround the plastic casing 2 to form an inner circle (not labeled) and an outer circle (not labeled). The area between the inner tangent line A of the mounting holes 41 in the inner circle (not labeled) and the outer tangent line B of the mounting holes 41 in the outer circle (not labeled) is almost 1 to 4 times of the total areas of the mounting holes 41 in the inner circle (not labeled) and the outer circle (not labeled), and preferably 1.2 to 4 times of the total areas of the mounting holes 41 in the inner circle (not labeled) and the outer circle (not labeled). FIG. 8 illustrates the angle $\alpha$ between the centers of two adjacent mounting holes 41 of the same circle the plate 4, and the angle $\beta$ between the edges of two adjacent mounting holes 41 of the same circle on the plate 4. The angle $\alpha$ is determined by the numbers of LED modules 1, and preferably ranges from 18 to 40 degrees. The angle $\beta$ is less than 10 degrees. The outer LED modules 1B of this embodiment comprises about 15 to 25 LED modules 1, and the inner LED module 1A of this embodiment comprises about 8 to 16 LED modules 1. The LED modules 1 of the same circle are spaced with each other by about 10 to 30 mm, and the LED modules 1 between the inner circle and outer circle are spaced with each other by about 14 to 22 mm.

As illustrated in FIGS. 9&10, the plate 4 further comprises a flange 43 formed along the edge of the plate 4, wherein the inner surface 43*a* of the flange 43 is inclined relative to the upper surface 4*a* of the plate 4, and a trench 6 is formed between the inner surface 43*a* of the flange 43 and the upper surface 4*a* of the plate 4. Therefore, sufficient air can be introduced into the thermal convection via the opening 121 of the side holes 12 by means of the trench 6 to facilitate the heat dissipation. The side holes 12 can be formed on lower side surface of the body 10 than before by means of forming the trench 6 to provide sufficient air and elongate the path of thermal convection, which provides a heat sink with a smaller size and better thermal dissipation.

Figure 11:
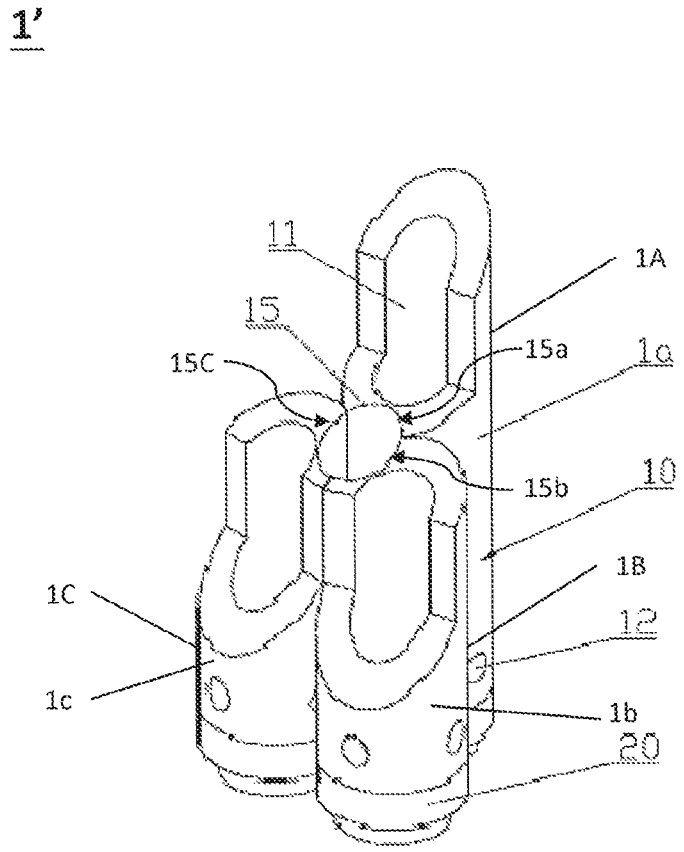
FIG. 11 illustrates a perspective view of another embodiment of the LED module for the LED lamp in FIG. 6.

Please refer to FIG. 11. In this embodiment, the LED lamp comprises a plurality of LED modules arranged to form concentric circles including an inner circle and an outer circle. The LED lamp comprises a plurality of LED units 1'. Each of the plurality of LED units 1' comprises three of the plurality of LED modules 1A, 1B, 1C adjacent to each other. One LED module 1A of each of the plurality of LED units 1' is arranged at the inner circle while the other two LED modules 1B, 1C of each of the plurality of LED units 1' are arranged at the outer circle. Hereinafter, the LED module 1A at the inner circle is referred as the first LED module 1A and the LED modules 1B, 1C at the outer circle are referred as the second and third LED modules 1B, 1C. As illustrated in FIG. 11, the first LED module 1A, the second LED module 1B and the third LED module 1C are attached to each other to form a triangle. Each of the three LED modules 1A, 1B, 1C of each of the LED units 1' has a trench on the surface adjacent to the other two LED modules. For example, a first trench 15*a* is formed on the outer surface 1*a* of the first LED module 1A along the longitudinal axis of the first LED module 1A; a second trench 15*b* is formed on the outer surface 1*b* of the second. LED module 1B along the longitudinal axis of the second LED module 1B; and a third trench 15*c* is formed on the outer surface 1*c* of the third LED module 1C along the longitudinal axis of the third LED module 1C. The first trench 15*a*, the second trench 15*b* and the third trench 15*c* are linked to each other to form a cavity 15 with a first aperture (not labeled) and a second aperture (not labeled) opposite to the first aperture (not labeled). The cavity 15 can be functioned as an additional thermal convection structure, which can further enhance the heat dissipation of the LED modules 1A, 1B, 1C of each of the LED units 1'. The shapes of the cross-sections of the trench 15*a*, 15*b* and 15*c* are arcs with an arc angle of around 120 degrees, in this embodiment. In other embodiments, trenches with suitable cross-sectional areas can also be selected as the trenches 15*a*, 15*b* and 15*c*. The LED lamp can comprise at least one of the LED unit 1', and the LED unit 1' can comprise more than 3 LED modules.

As mentioned above, the LED modules of some embodiments can be selected and assembled in many ways to generate LED lamps with various power, which can not only reduce the fabrication cost but also facilitate the assembly of the LED lamps.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An LED lamp, comprising:

a plurality of LED modules, each of the LED modules comprising a heat sink body having a first terminal, a second terminal opposite to the first terminal, an airway having an opening at the second terminal, and at least one side hole on the side surface of the body;

wherein the at least one side hole communicates with the corresponding airway, the plurality of LED modules are aligned to form concentric circles including an inner circle and an outer circle, and the length between the first and the second terminals of each of the plurality of LED modules at the inner circle is longer than the length between the first and the second terminals of each of the plurality of LED modules at the outer circle.

2. The LED lamp as claimed in claim 1, further comprising a plate, wherein the plate comprises a plurality of mounting holes thereon, each of the plurality of LED modules comprises a connecting part corresponding to one of the heat sink body, each of the connecting part is on the first terminal of the corresponding heat sink body, and the plurality of LED modules is respectively connected with the plurality of mounting holes.

3. The LED lamp as claimed in claim 2, wherein the plate further comprises a flange along the edge of the plate.

4. The LED lamp as claimed in claim 3, wherein an inner surface of the flange is inclined relative to an upper surface of the plate, and a trench is between the inner surface of the flange and the upper surface of the plate.

5. The LED lamp as claimed in claim 2, wherein the area between the inner tangent line of the mounting holes on the inner circle and the outer tangent line of the mounting holes on the outer circle is one to four times of the total areas of the plurality of mounting holes.

6. The LED lamp as claimed in claim 5, wherein each of the plurality of heat sink body comprises a stepped surface at the second terminal of the heat sink body, the stepped surface comprises an upper inclined surface, a lower inclined surface, and a shoulder surface connected between the upper and the lower inclined surfaces, and a distance from the plate to the lower inclined surface of each of the plurality of LED module at the inner circle is longer than a distance from the plate to the upper inclined surface of each of the plurality of LED modules at the outer circle.

7. The LED lamp as claimed in claim 6, wherein the ratio of the height h1 of the connecting part over the height H of the LED module is about 0.04 to 0.25, and the ratio of the height h2 of the shoulder surface to the height H of the LED module is about ⅙ to ½.

8. The LED lamp as claimed in claim 5, wherein a position of each of the openings of the plurality of the LED modules at the inner circle is higher than, from the plate, a position of each of the openings of the plurality of the LED modules at the outer circle.

9. The LED lamp as claimed in claim 5, wherein a position of each of the openings of the plurality of the LED modules at the inner circle is higher than, from the plate, a position of the corresponding second terminal of the plurality of the LED modules at the outer circle.

10. The LED lamp as claimed in claim 1, wherein the LED lamp comprises a plurality of LED units, each of the plurality of LED units comprises three of the plurality of LED modules adjacent to each other, one LED module of each of the plurality of LED units is arranged on the inner circle and the other two LED modules of each of the plurality of LED units are arranged on the outer circle.

11. The LED lamp as claimed in claim 10, wherein each of the three LED modules of each of the LED units has a trench on the surface adjacent to the other two LED modules, the longitudinal axes of the trenches are substantially parallel to the longitudinal axes of the heat sink bodies of the LED units, the three adjacent trenches forms a channel with a first aperture and a second aperture opposite to the first aperture.

12. The LED lamp as claimed in claim 11, the shape of the cross-section of each of the trenches is arc with an arc angle of 120 degrees.

13. The LED lamp as claimed in claim 1, wherein each of the plurality of LED modules comprises at least one LED, the LEDs are connected with each other in series, and the in-series-connected LEDs are connected with a power supplying source.

14. A heat sink for an LED module, comprising a heat sink body, the heat sink body having a first terminal, a second terminal opposite to the first terminal, an airway having an opening at the second terminal, and at least one side hole on the side surface of the body and communicating with the airway, wherein a surface of the second terminal is a stepped surface or an oblique surface, and wherein the heat sink body comprises a stepped surface, the stepped surface comprises an upper inclined surface, a lower inclined surface, and a shoulder surface connected between the upper and the lower inclined surfaces, and the longitudinal axis of the shoulder surface is substantially parallel to the longitudinal axis of the airway.

15. The heat sink for the LED module as claimed in claim 14, wherein the shoulder is substantially on the same surface as the longitudinal axis of the airway on.

16. The heat sink for the LED module as claimed in claim 14, wherein the upper inclined surface and the lower inclined surface are not substantially parallel to each other.

17. The heat sink for a LED module as claimed in claim 14, wherein the upper inclined surface and the lower inclined surface are substantially perpendicular to the longitudinal axis of the airway.

18. The heat sink for the LED module as claimed in claim 14, wherein the upper inclined surface and the lower inclined surface are substantially parallel to each other.

19. The heat sink for the LED module as claimed in claim 14, wherein the heat sink body comprises an oblique surface, the normal line to the oblique surface and the longitudinal axis of the airway creates an acute angle.

20. The heat sink for the LED module as claimed in claim 14, wherein the shape of the cross-section of the heat sink body along a surface perpendicular to the longitudinal axis of the heat sink body is circular or rectangular.

* * * * *